US005172916A

United States Patent [19]

Puckett

[11] Patent Number: 5,172,916

[45] Date of Patent: Dec. 22, 1992

[54] BROADHEAD WITH IMPROVED FLIGHT CHARACTERISTICS AND PIVOTABLE BLADES

[75] Inventor: Riley Puckett, Lorton, Va.

[73] Assignee: Pucketts Blodtrailer Broadhead, Inc., Lorton, Va.

[21] Appl. No.: 816,472

[22] Filed: Jan. 3, 1992

[51] Int. Cl.[5] ..... F42B 6/08

[52] U.S. Cl. ..... 273/421

[58] Field of Search ..... 273/420–422

[56] References Cited

U.S. PATENT DOCUMENTS

D. 279,813 7/1985 Palizzolo ..... D22/115
2,859,970 11/1958 Doonan ..... 273/421
4,932,671 6/1990 Anderson, Jr. ..... 273/421
4,976,443 12/1990 DeLucia ..... 273/421
4,998,738 3/1991 Puckett ..... 273/421
5,082,292 1/1992 Puckett et al. ..... 273/421

*Primary Examiner*—Paul E. Shapiro
*Attorney, Agent, or Firm*—Whitham & Marhoefer

[57] ABSTRACT

A broadhead (1) has cutout regions (28) at the rear of cutting blades (14 and 16) to reduce adverse wind effects on the flight of an arrow. The cutting blades (14 and 16) are held in a barbed configuration by frictionally secured rings (20). The cutting blades (14 and 16) pivot to a nonbarbed the rings (20) moving towards tip (2). A threadably connectable arrow shaft protector (8) reduces the costs of manufacturing.

5 Claims, 2 Drawing Sheets

BROADHEAD WITH IMPROVED FLIGHT CHARACTERISTICS AND PIVOTABLE BLADES

BACKGROUND OF THE INVENTION

1. Field of the Invention

The subject invention is generally directed to a broadhead used for hunting game animals and, more particularly, to a broadhead which pivots from a barbed configuration while in flight to a nonbarbed configuration when the broadhead is being withdrawn from a game animal.

2. Description of the Prior Art

A broadhead is a particular type of arrow head which has outwardly extending blades that inflict more extensive damage to a game animal such as a deer. Broadheads have been used in hunting for many years and there are many different broadhead designs which have developed. FIG. 1 shows a side view of a typical example of a prior art broadhead 100 which has cutting blades 102 that extend radially outward from the body 104. The cutting blades 102 are often clipped to the body 104 or affixed by some other means; however, they are sometimes integrally formed with the body 104. The broadhead 100 may have three or four cutting blades 102, and they are spaced at equal angular locations about the body 104 so that the broadhead 100 will be in balance. The body 104 is normally secured to the end of an arrow shaft (not shown) by a threadable connection or the like.

Most states have gaming laws which require that the broadhead 100 be of a certain diameter where the diameter is defined as the width between the radial ends 106 of opposing cutting blades 102. The main objective of any broadhead is to kill its prey as quickly as possible, and wider diameter broadheads 100 will meet this objective more readily since they will inflict more extensive damage as the arrow passes through the animal. Broadheads having less than the legal diameter will tend not to inflict as much damage, resulting in a slower kill that makes recovery of the animal less likely. Animals which are mortally wounded but not recovered are often not reported to the game warden, and this creates problems for proper wildlife management.

In addition, most states have gaming laws which require that the broadhead 100 have a nonbarbed configuration. That is, the angle made by the body 104 and the cutting blade 102 should be less than 90°. As can be seen in FIG. 1, many broadheads 100 meet this criteria by providing a region 108 on the rear portion of the cutting blades 102. Region 108 does not contribute to the cutting impact of the broadhead 100, but merely provides a more acute angle relative to the body 104. The requirement of a nonbarbed configuration relates to the desire of the state gaming commissions that the animal which has been struck by a broadhead should be able to pull the arrow from its body.

The main problem with prior art broadheads 100 experienced by hunters is that wind shear acts on the cutting blades 102 during the flight of the arrow and causes it to drift off course. Hence, prior art broadheads 100 tend to be less accurate than target arrows. The cutting blades 102 also contribute to the overall surface area of the broadhead 100 and, thus, create a frictional drag which slows the arrow during flight. Recently, there has been much effort in addressing the problems of wind shear and wind drag by providing mechanical broadheads with deployable blades. Typical examples of broadheads with deployable blades are found in U.S. Pat. Nos. 4,998,738 to Puckett, 4,976,443 to DeLucia, 4,932,671 to Anderson, Jr., and 2,859,970 to Doonan. These broadheads eliminate or attempt to eliminate the affects of wind shear and drag by causing the cutting blades to remain retracted within a body ferrule during the flight of the arrow. Upon impact with the animal, the blades are intended to spring open to a cutting position which will cause maximum hemorrhaging to the animal. U.S. Pat. Nos. 4,976,443 to DeLucia and 4,932,443 to Anderson, Jr., as well as the co-pending U.S. patent application to Puckett et al. having Ser. No. 07/637,491 filed Jan. 3, 1991, now U.S. Pat. No. 5,082,292, all show mechanical broadheads which have blades that pivot from a barbed "impact" configuration to a nonbarbed "withdrawal" configuration.

A major drawback of the mechanical broadheads described by Puckett, DeLucia, Anderson, and Doonan, is that they are complicated and require the assembly of many parts. The high number of total parts and their mechanical operating mechanism also contributes much to manufacturing costs. Furthermore, a few states in the U.S. do not permit hunting with mechanical broadheads.

FIGS. 1-3 of U.S. Design Patent Des. No. 279,813 to Palizzolo shows a broadhead which has partially retracting pivotable blades which move upward to a nonbarbed configuration to facilitate removal from the animal. A major drawback of Palizzolo's design is that the cutting blades open during flight; not upon impact.

SUMMARY OF THE INVENTION

It is therefore an object of the present invention to provide a broadhead designed to reduce adverse wind affects, stay on target, and inflict extensive damage to the animal, but still allow either the hunter or the wounded animal to easily remove the broadhead.

It is another object of the present invention to provide a broadhead which is less costly to manufacture.

According to the invention, two pairs of cutting blades are pivotally mounted on pivot pins positioned within slots extending through a broadhead body. The slots are angularly spaced by 90° around the broadhead body and are offset by a short longitudinal distance to accommodate the pairs of cutting blades. In the in-flight position, each pair of cutting blades is securely held in a barbed configuration by a biasing ring frictionally secured about the broadhead body. The width between the outwardly projecting ends of the pairs of cutting blades is chosen to meet the diameter requirements of state gaming laws. When the arrow is pulled from the animal, the blades pivot on their respective pivot pins to a nonbarbed configuration while pushing the biasing rings towards the broadhead point. Hence, the broadhead meets the requirements of most state game laws.

It has been determined that using a barbed cutting blade configuration reduces the total surface area of the broadhead and, thereby decreases adverse wind effects. In field trials, the broadhead has been found to fly extremely accurately. The biasing rings firmly hold the cutting blades in the barbed configuration so that the cutting blades do not experience a shifting center of mass problem or a wind effect problem which would result if the cutting blades were free to translate about the pivot pin fulcrum during flight.

In addition, because of the reduced number of parts, the broadhead is more manufacturing and user friendly.

It is contemplated that the broadhead could be sold in a blister pack containing four cutting blades, two pivot pins, the broadhead body, and a shaft protector. Users would simply need to attach the shaft protector to the threaded end of the broadhead body and affix the cutting blades in the slots of the broadhead body. The shaft protector is considered to be a significant advance in the manufacturability and utility of the broadhead since the broadhead body would only need to be threadably milled at one end, thereby eliminating a special die requirement for the body, and different diameter shaft protectors could be attached to accommodate the arrow shafts of the user, hence, the broadhead would have more utility than a design with an integrally molded shaft protector.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF THE PREFERRED EMBODIMENTS OF THE INVENTION

Figure 2:
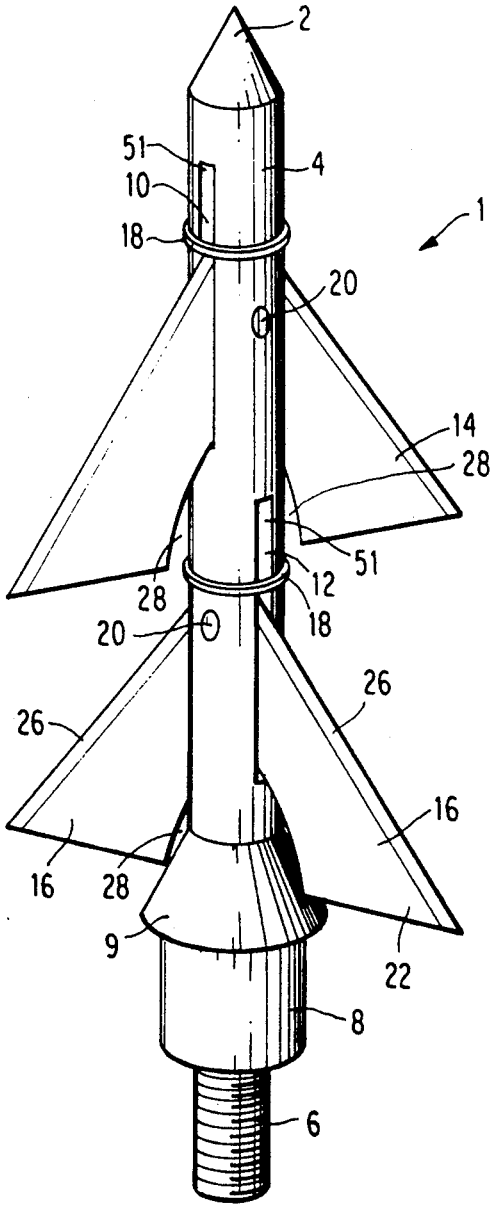
FIG. 2 is an isometric view of the broadhead of the present invention showing the blades angled downward with respect to the broadhead body in the "in-flight" or barbed configuration.
Figure 3:
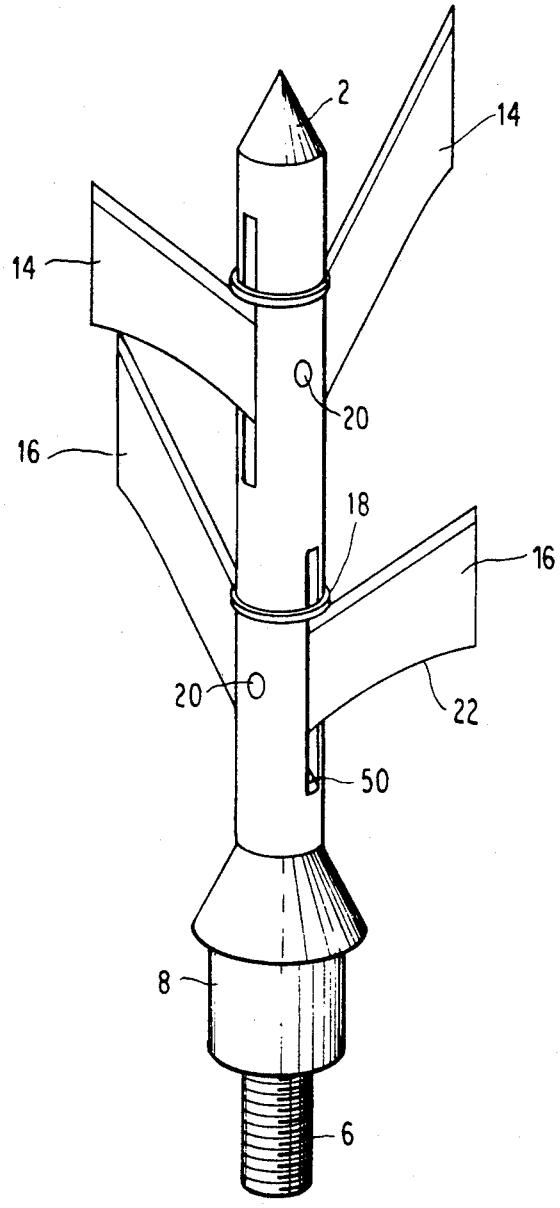
FIG. 3 is an isometric view of the broadhead shown in FIG. 2 with the blades angled upward in the non-barbed, "withdrawal" or "removal" configuration.
Figure 4:
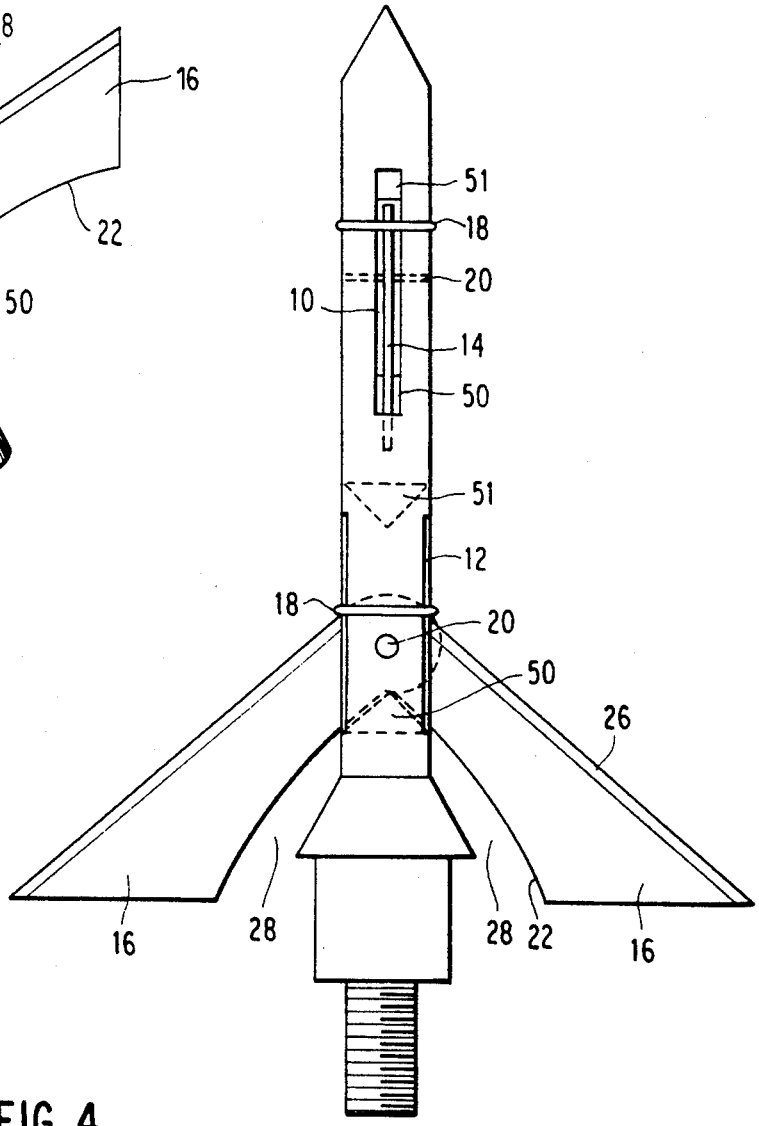
FIG. 4 is a cross-sectional side view of the broadhead of the present invention showing the lower pair of cutting blades pivotally mounted on the pivot pin in the lower slot.

Referring now to the drawings, and more particularly to FIGS. 2–4, there is shown a broadhead 1 in its "in-flight" or barbed configuration in FIG. 2, the broadhead 1 in its "removal" or non-barbed configuration in FIG. 3, and a cross-sectional side view showing the inner mechanics of the broadhead 1. Like reference numerals FIGS. 2–4 indicate like elements.

The broadhead 1 has a pointed tip 2, a cylindrical body 4 and a threaded bottom 6. The threaded bottom 6 is used to secure the broadhead 1 to the end of an arrow shaft. In addition, the threaded bottom 6 accommodates an arrow shaft protector 8 which is simply threaded onto threaded bottom 6 prior to installation of the broadhead 1 on an arrow shaft. The arrow shaft protector 8 includes a lower region which fits into a counter bore in the end of the arrow shaft and an upper shoulder region 9 which has a diameter as wide as the diameter of the arrow shaft. It has been determined that having a separate arrow shaft protector 8 reduces manufacturing costs because a special die to create and integrally formed shoulder region 9 is not required. Moreover, having a separate arrow shaft protector 8 may allow easier accommodation of different diameter arrow shafts since only a new protector 8 with a different diameter shoulder 9 would need to be produced.

The cylindrical body 4 has upper and lower slots 10 and 12 which have pairs of upper and lower cutting blades 14 and 16, respectively, projecting radially outwardly therefrom. Preferably, the slots 10 and 12 are angularly offset by 90° so that individual cutting blades 14 and 16 will be positioned every 90° around the periphery of the body 4. The pairs of upper and lower cutting blades 14 and 16 are each pivotally mounted within their respective slots 10 and 12 by pivot pins 20 that extend through the cylindrical body 4 and the fulcrum ends of the cutting blades 14 and 16. As is best shown by contrasting FIGS. 2 and 3, the fulcrum ends of the cutting blades 14 and 16 pivot about pivot pins 20 so that the projecting ends can move from a barbed to nonbarbed configuration; thereby, complying with state gaming laws. Preferably, the width between the projecting ends of at least one of the pairs of cutting blades 14 and 16 is sufficient to comply with state gaming laws.

As is best shown in FIG. 4, in the in-flight configuration, the lower edge 22 of the cutting blades 14 and 16 rests against either side of a lower triangular stop 50. The cutting blades 14 and 16 are held firmly in place in the in flight, barbed configuration by biasing rings 18 which are frictionally held about the periphery of the body 4 at a point adjacent the sharpened edges 26 of the cutting blades 14 and 16. The biasing rings 18, which may be circular, partially circular or split, slide forward on the body 4 toward the point 2 under the force of a hunter or the game animal itself pulling on the arrow shaft to remove the broadhead 1 from the game animal's body. Hence, the biasing rings 18 do not lock the blades 14 or 16 into an illegal barbed configuration. In the nonbarbed configuration, the sharpened edges 26 of the cutting blades 14 an 16 rest against upper triangular stops 51.

However, the biasing rings 18 exert sufficient pressure to firmly hold the cutting blades 14 in a barbed configuration during flight so that no shifting center of mass or wind effects are encountered, as would be the case if the blades 14 and 16 were freely pivottable during flight. For example, if no biasing rings 18 were provided, there would be a tendency, due to gravity or other influences, for the cutting blades to hang downwardly from the pivot pins 20 during flight rather than be held rearward in a barbed configuration. Such a situation would make wind effects far more pronounced.

Figure 1:
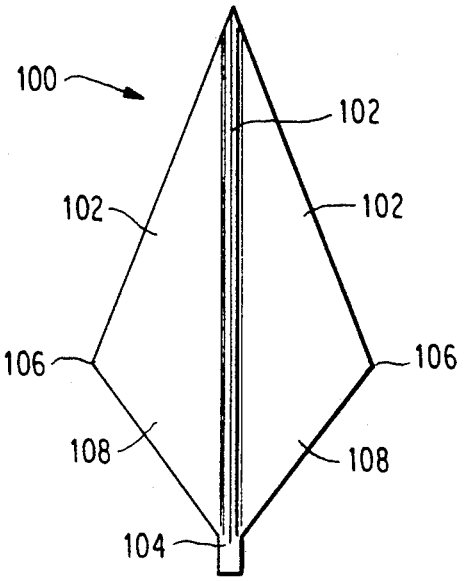
FIG. 1 PRIOR ART
FIG. 1 is a prior art broadhead design.

The cutting blades 14 and 16 are shaped to provide triangularly shaped spaces 28 between the non-sharpened edges 22 of the cutting blades 14 and 16 and the body 4. It has been found that having spaces 28 instead of a solid cutting blade (note region 108 of FIG. 1) reduces the surface area of the cutting blades 14 and 16 and, thereby, reduces the adverse effects of the wind on the cutting blades 14 and 16. Field trials of the broadhead 1 have shown that the broadhead is extremely accurate.

It is anticipated that the broadhead will lend itself to be "user assembled" and thereby reduce manufacturing and packaging costs. The broadhead 1 could be sold in a blister pack containing four cutting blades, two pivot pins, the broadhead body, and a shaft protector. Users would simply need to attach the shaft protector 8 to the threaded end 6 of the broadhead body 4 and affix the cutting blades 14 and 16 in the slots 10 and 12, respectively, of the broadhead body 4. The pivot pins 20 may be of the coiled type, wherein the pin comprises a thin sheet is tightly coiled which allowed to "unravel" to tightly fit within the pivot-pin hole, or may simply a straight pin which will be forced in with needle nose pliers.

While the invention has been described in terms of its preferred embodiments, those skilled in the art will recognize that the invention can be practiced with modification within the spirit and scope of the appended claims.

Having thus described my invention, what I claim as new and desire to secure by Letters Patent is as follows:

1. A broadhead, comprising:

a body having a threaded end attachable to an arrow shaft and a pointed end;

a first slot in said body positioned at a first longitudinal location with respect to said threaded end of said body;

a first pair of cutting blades pivotally mounted on a first pivot pin within said first slot in said body, each of said first pair of cutting blades having a fulcrum end and a projecting end wherein said fulcrum end is connected to said pivot pin and said projecting end projects out of said first slot and radially away from said body, said first pair of cutting blades being pivotable from a barbed configuration wherein a rear portion of each of said first pair of cutting blades forms an acute angle with a longitudinal axis of said body extending from said threaded end of said body to a nonbarbed configuration wherein said rear portion of each of said first pair of cutting blades forms an obtuse angle with said longitudinal axis of said body extending from said threaded end of said body; and a first ring member frictionally secured to an outer perimeter of said body, said first ring member slidable to a position for holding said first pair of cutting blades in said barbed configuration.

2. A broadhead as recited in claim 1 further comprising a shaft protector threadably attachable to said threaded end of said body.

3. A broadhead as recited in claim 1, further comprising:

a second slot in said body positioned at a second longitudinal location with respect to said threaded end of said body;

a second pair of cutting blades pivotally mounted on a second pivot pin within said second slot in said body, each of said second pair of cutting blades having a fulcrum end and a projecting end wherein said fulcrum end is connected to said pivot pin and said projecting end projects out of said second slot and radially away from said body, said second pair of cutting blades being pivotable from a barbed configuration wherein a rear portion of each of said second pair of cutting blades forms an acute angle with a longitudinal axis of said body extending from said threaded end of said body to a nonbarbed configuration wherein said rear portion of each of said second pair of cutting blades forms an obtuse angle with said longitudinal axis of said body extending from said threaded end of said body; and a second ring member frictionally secured to an outer perimeter of said body, said second ring member slidable to a position for holding said first pair of cutting blades in said barbed configuration.

4. A broadhead as recited in claim 3 further comprising a shaft protector threadably attachable to said threaded end of said body.

5. A broadhead as recited in claim 3 wherein said first and second slots are angularly offset by 90° with respect to said longitudinal axis of said body.

* * * * *